United States Patent [19]

Jones

[11] Patent Number: 4,757,568

[45] Date of Patent: Jul. 19, 1988

[54] PAINT BRUSH HAVING SUPPORTING AND PRYING MEANS

[76] Inventor: John A. Jones, 6312 Fairfield Dr., Flourtown, Pa. 19031

[21] Appl. No.: 13,594

[22] Filed: Feb. 11, 1987

[51] Int. Cl.[4] ..... A46B 17/00

[52] U.S. Cl. ..... 15/105; 15/246; 220/90; 248/110; 7/151; 81/3.57

[58] Field of Search ..... 15/105, 246, 257 R, 15/DIG. 4; 220/90; 248/110, 210, 211, 111, 360; 206/15.2, 15.3, 361, 362; 211/66; 81/3.15, 3.55, 3.57, 3.09; 7/105, 151

[56] References Cited

U.S. PATENT DOCUMENTS

| | | | |
|---|---|---|---|
| 2,625,299 | 1/1953 | Uhlig | 220/90 |
| 3,432,875 | 3/1969 | Edelson et al. | 15/246 |
| 3,536,285 | 10/1970 | Vaughn | 248/110 X |
| 4,627,125 | 12/1986 | Gruns . | |

*Primary Examiner*—Peter Feldman
*Attorney, Agent, or Firm*—Beveridge, DeGrandi & Weilacher

[57] ABSTRACT

A paint brush having a ferrule telescopically receiving a handle at one end and the bristles at the other is disclosed with supporting and prying means on one side thereof for adapting the brush to hang from the rim of a paint can, in spaced relation from the walls of the can, and to pry off the lid of the can. The supporting and prying device includes a prying portion which projects outwardly of the ferrule and a hook portion located between the prying portion and the end of the ferrule that receives the handle. An adapter member for adapting a conventional paint brush to hang from the rim of a paint can and to adapt the brush to provide a tool for prying open the can is also disclosed as including a base portion, a prying portion and a hook portion. The base portion is mountable to one side of the ferrule whereby the prying portion and the hook portion project outwardly from the base portion and the ferrule. In both the paint brush and the adapter member, the hook portion is spaced apart from the prying portion so that the prying and hook portions are adapted to support the brush within the can with the bristles oriented downwardly. The handle and the ferrule provide a leverage device that cooperates with the prying portion for prying open the can.

21 Claims, 1 Drawing Sheet

FIG. 1
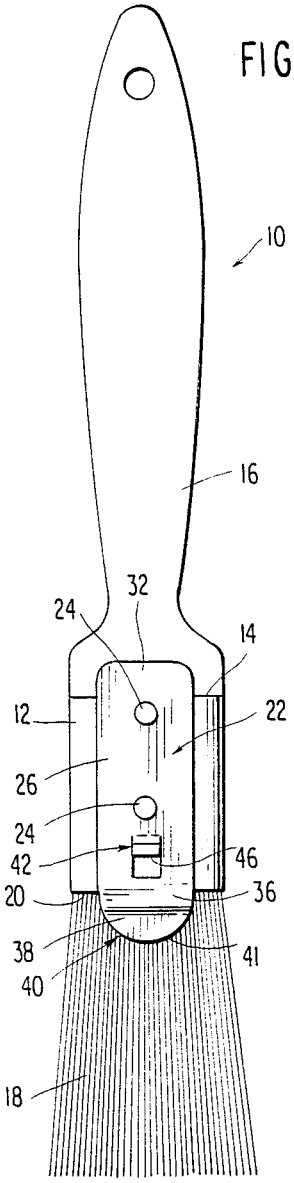
FIG. 2
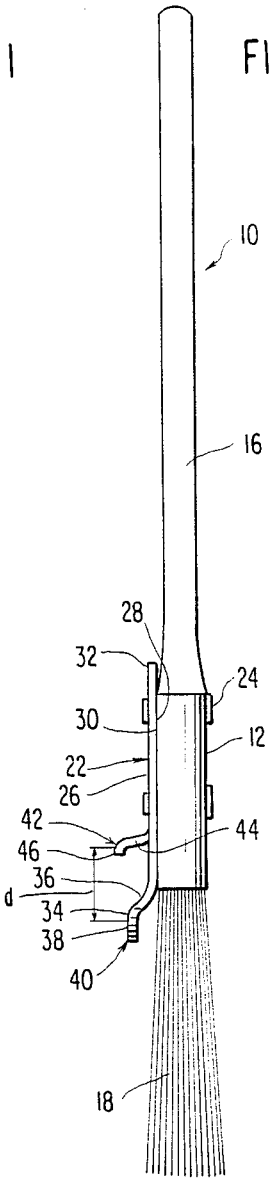
FIG. 3
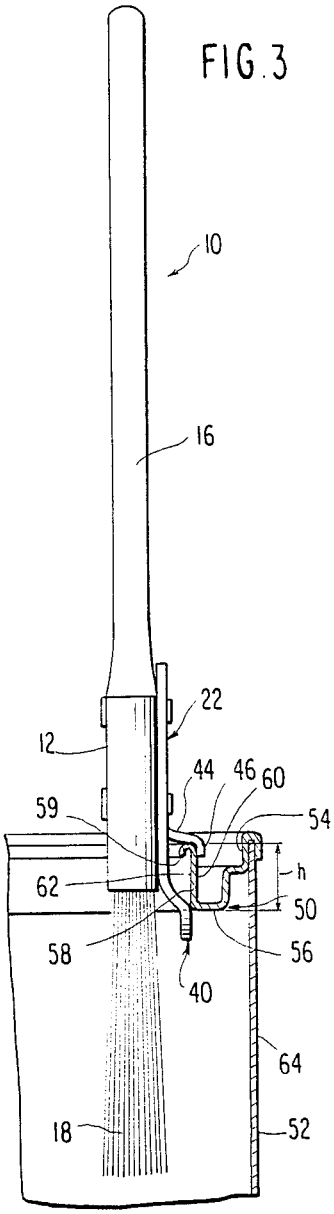
FIG. 4
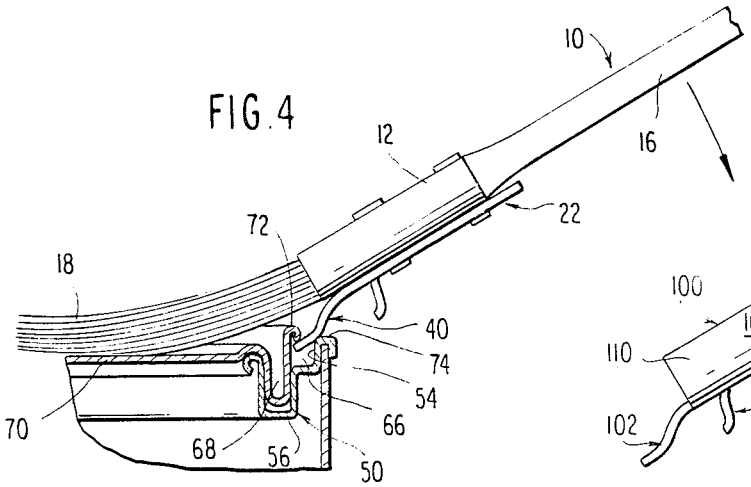
FIG. 5
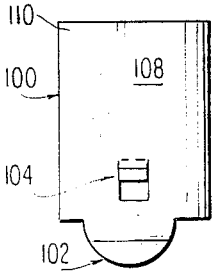
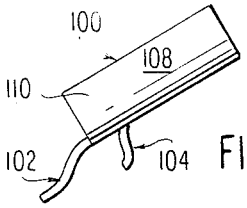
FIG. 6

PAINT BRUSH HAVING SUPPORTING AND PRYING MEANS

BACKGROUND OF THE INVENTION

The present invention pertains to a paint brush having supporting and prying means for adapting the brush to hang from the rim of a paint can with the bristles oriented downwardly into the can, and further for adapting the brush to provide means for prying off the lid of the can to open the can. More particularly, the present invention pertains to a paint brush having a supporting and prying member, which member includes a prying portion and a hook portion. Both portions project outwardly of the ferrule portion of the brush whereby they are adapted to receive the rim of the can between them, to contact the can and to cooperate with each other and the can for supporting the brush from the rim of the can.

The present invention further relates to an adapter member, mountable to a paint brush, for adapting the brush to provide a tool for prying open a paint can and further for adapting the brush to hang from the rim of the can with the bristles directed downwardly.

U.S. Pat. No. 3,275,187 to Lamoureaux discloses a painter's implement which can be used to pry off paint can lids in addition to supporting the brush on the can in such a way that excess paint will flow down into the can. The Lamoureaux device is an integral tool having an elongated handle with an enlarged head at one end thereof. The tool is provided with slightly resilient mounting ears, adjacent the enlarged head, which snap onto the can rim to support the tool upon the rim in a position with the head at a downward inclination into the interior of the can. U.S. Pat. No. 3,275,187 states that preferably, the tool is case hardened to permit the use of extensions on the handle portion as a means for prying off paint can lids. The tool is also equipped with upstanding walls which provide means for attaching a scraping member to the tool and a channel for conducting excess paint into the can.

In U.S. Pat. No. 2,309,990 to Savi there is disclosed a brush hook for suspending a paint brush from the walls of a paint can. The hook member extends from the ferrule of the brush to support the brush substantially vertically within the can.

U.S. Pat. Nos. 2,717,407 and 2,938,224 to Hanhart and Foulkes, respectively, show paint brushes equipped with guide elements for aiding the painter in painting in more difficult areas, such as for example, around a window. The guide members also provide means for hooking the brush to the walls of the can to suspend the bristles within the paint. U.S. Pat. Nos. 888,896; 2,988,768; 3,432,875; 4,490,875; 4,553,279 and 4,629,125 also disclose hooks and various other arrangements for supporting a brush either within or along side of a paint can.

SUMMARY OF THE INVENTION

The paint brush having supporting and prying means according to the present invention comprises a conventional paint brush with a tubular ferrule telescopically receiving a handle at one end thereof and the bristles at the other end. The supporting and prying means includes a prying portion and a hook portion. The hook portion is positioned between the prying portion and the end of the ferrule that receives the handle. The prying portion and the hook portion project outwardly of the ferrule. Thus the prying and hook portions are adapted to receive the rim of a paint can between them whereby the two portions contact the can and cooperate with the can and each other to support the brush on the can with the bristles spaced away from the walls of the can and oriented downwardly into the can. The prying portion is also adapted to cooperate with leverage means, furnished by the brush handle and ferrule, to provide means for prying off the lid of the can.

As a result of the present invention, a paint brush is provided which easily can be hooked over the rim to allow paint to drip back into the can and thereby keep the handle free of paint. The paint brush according to the present invention also provides a tool for opening the top of a can by prying the top open without bending or twisting the lid to later enable easy replacement of the lid. The brush according to the present invention is configured to pry the lid from a friction or plug type paint can of any size. Moreover, the supporting and prying means does not interfere with the normal use of the brush during painting, nor does it interfere with the packaging, transportation, or display of the brush for retail sales purposes.

A paint brush according to the present invention includes an elongate handle, bristles for applying paint, and a tubular ferrule which telescopically receives the handle in one end thereof and anchors the bristles in the other end. Supporting and prying means are provided for supporting the brush on the rim of the can, in spaced relation to the side walls of the can, and for enabling the brush to be used to pry open the can by the cooperation of the supporting and prying means, with leverage means provided by the handle and the ferrule. The prying portion projects outwardly of the ferrule as does the hook portion which is located between the prying portion and the end of the ferrule that receives the handle.

Both the prying and hook portions project outwardly from the same side of the ferrule. The prying and hook portions are spaced apart and are thus adapted to receive the rim of the paint can between them. In this way the prying and hook portions are adapted to contact the can and cooperate therewith in supporting the brush from the rim of the can with the bristles oriented downwardly, into the can. The prying portion is specially adapted to cooperate with the leverage means for prying open the can.

Further according to the present invention, an adapter member is provided for adapting a paint brush to hang from the interior rim of a can and to provide a tool for prying the lid of the can to open the can. The adapter member comprises a base portion having two longitudinal ends, a front face and a rear face. Preferably, the base portion is mountable to the ferrule and the handle of the brush with the two longitudinal ends of the base portion aligned with the brush. The rear face of the base portion contacts a side of the ferrule. One of the longitudinal ends comprises a prying portion which projects outwardly from the front face of the base portion. A hook portion is located between the prying portion and the other end of the base portion at a position in spaced relation to the prying portion. The hook portion also projects outwardly from the front face of the base portion whereby the prying portion and the hook portion are adapted to contact the can and cooperate with the can to support the adapted brush from the can. Further, the handle and the ferrule provide leverage means that cooperates with the prying portion for prying the lid off the can.

BRIEF DESCRIPTION OF THE DRAWINGS

These and other aspects of the present invention are more apparent from the following detailed description and claims, particularly when considered in conjunction with the accompanying drawings in which like parts bear like reference numerals. In the drawings:

FIG. 1 is a front elevational view of a paint brush with supporting and prying means in accordance with a preferred embodiment of the present invention;

FIG. 2 is a side elevational view of the paint brush of FIG. 1;

FIG. 3 is a view, similar to FIG. 2, wherein the supporting and prying means is shown as engaging the interior rim of a paint can to support the brush upon the rim with the bristles of the brush oriented downwardly;

FIG. 4 is a side view of the paint brush of FIGS. 1–3 with the supporting and prying means engaging the lid and the rim of the can to pry the lid from the can;

FIG. 5 is a downwardly looking view of an alternative embodiment of an adapter member according to the present invention; and FIG. 6 is a side view of the adapter member of FIG. 5.

DETAILED DESCRIPTION OF THE PREFERRED EMBODIMENTS OF THE INVENTION

FIGS. 1 and 2 are front and side elevational views, respectively of a paint brush 10 according to the present invention. Paint brush 10 includes a tubular ferrule 12 receiving at its upper end 14 a handle 16 and bristles 18 at its lower end 20. Handle 16 may be constructed of a plastic material or alternatively of wood. Ferrule 12 and bristles 18 are conventional, and in this respect, so far as described, brush 10 is of the conventional type.

Supporting and prying means 22 is mounted to one side of ferrule 12. Supporting and prying means 22 is attached to ferrule 12 by means of studs 24 extending through the ferrule and that portion of handle 16 which is telescopically received within the ferrule. Of course, means 22 can be mounted to ferrule 12 and handle 16 by any other fastening elements. Alternatively, as is apparent to one of ordinary skill in the subject art, means 22 could be formed with the ferrule or means 22 could be formed as a sleeve which fits over ferrule 14 and is likewise secured thereon by fastening elements.

Supporting and prying means 22 has a base portion 26 having a rear face 28 for contacting the ferrule and a front face 30. Upper end 32 of supporting and prying means 22 is integral with base portion 26 and, together with base portion 26, lies in a first plane parallel with the plane defined by the side of ferrule 12 to which the base portion is mounted.

Lower end 34 of supporting and prying means 22 comprises an upstanding portion 36 connecting a flat portion 38 to base portion 26. Preferably, portion 38 is flattened so as to lie in a second plane above, and generally parallel with that defined through base portion 26. Upstanding portion 36 inclines upwardly with respect to base portion 26 to provide a clearance between bristles 18 and portion 38. Upstanding portion 36 and flat portion 38, connected at the end of base portion 26, together provide a prying portion 40 for supporting and prying means 22.

In FIG. 1, prying means 40 is shown as having a rounded prying edge indicated by reference numeral 41. So configured, prying means 40 with prying edge 41 is designed to remove the lid from any plug or friction type paint can, without bending or twisting the lid, to provide for facilitated replacement of the lid to protectively reseal any unused paint in the can. While rounded prying edge 41 is preferred, the prying edge could be flat or have other configurations but the resulting implement would still fall well within the scope of the present invention.

A hook portion 42 is located on base portion 26 between prying means 40 and upper end 32. Hook portion 42 likewise includes an upstanding portion 44 projecting outwardly from base portion 26. Upstanding portion 44 of hook portion 42 terminates in a bent-over claw portion 46 for engaging the rim of a paint can as will be discussed further in the following.

As can be seen from FIGS. 2–4, upstanding portion 44 has a greater slope with respect to base portion 26 and the plane defined thereby than does upstanding portion 36 of prying means 40. Accordingly, bent-over claw portion 46 defines a third plane which is elevated with respect to the second plane defined by flat portion 38 of prying means 40. In other words, bent-over claw portion 46 projects further outwardly from base portion 26 than does flat portion 38 of prying means 40.

Preferably, supporting and prying means 22 is constructed from a very rigid and strong material such as metal, e.g. steel, in order to provide sufficient strength for prying open the lid of a paint can. Indeed, where prying and supporting means 22 is constructed from metal or steel, the prying and supporting means can be formed as one flat piece and then cut and stamped to form prying portion 40 and hook portion 42.

In FIG. 3, supporting and prying means 22 is shown as supporting brush 10 from the rim 50 of a paint can 52. Can 52 is conventional and is of the friction or plug type. Accordingly, interior rim 50 has a descending section 54 terminating in a U-shaped section 56. The inner wall 58 of U-shaped section 56 has an outwardly facing side 60 and an inwardly facing side 62.

To support brush 10 within can 52, the brush is manually positioned so that hook portion 42 engages over the bead 59 of inner wall 58 such that bent-over claw portion 46 contacts outer side 60 of the inner wall while prying portion 40 contacts inner side 62 of wall 58. Prying portion 40 and hook portion 42 thus cooperate to support brush 10 from the inner wall 58 of the can in such a way that bristles 18 are directed downwardly, into the can, to direct the flow of any paint, dripping therefrom, back into the can. Preferably, the difference in elevation or length of projection outwardly from base portion 26 of prying and hook portions 40 and 42 will approximately correspond to the width of inner wall 58 of can 52. Alternatively, the difference in projection lengths between prying and hook portions 40 and 42 could correspond to the entire width of rim 50 and outer wall 64 whereby claw-portion 46 would extend over wall 58, U-shaped section 56, descending section 54 and engage outer can wall 64.

Further, as is seen from FIGS. 2 and 3 the distance, d, between upstanding portion 44 of hook portion 42 and flat portion 38 of prying means 40 is less than or equal to the height, h, of inner wall 58. In this way, it is assured that prying means 40 will contact outer side 62 of wall 58 and thus brush 10 will be supported preferably nearly vertically with respect to wall 64. In any event, prying means 40 and hook means 42 should cooperate with can 52 to keep bristles 18 in spaced relation with respect to wall 64 and thereby prevent bowing of the bristles as a result of prolonged contact with the wall.

In a slightly different arrangement for the supporting and prying means, the flat portion of the prying means could directly abut wall 64 of the can rather than wall 58 of the rim. In such an arrangement, the spacing, d, between the upstanding portion of the hook portion and the flat portion of the prying portion would be greater than the height, h, of wall 58 and the upstanding portion of the prying portion would project outwardly further than the upstanding portion of the hook portion to likewise receive rim 50 between the hook and prying portions. While such an embodiment with the prying portion arranged to contact wall 64 of the can is within the scope of the present invention, the embodiment of FIGS. 1–4 is preferred to provide contact between the prying portion and the rim inner wall 58. This preferred arrangement prevents the accumulation of paint on the supporting and prying means from any paint present on the interior surfaces of sidewall 64.

In FIG. 4, brush 10 is shown as being positioned so that prying means 40 extends into the space 66 between a male U-shaped section 68 of lid 70 and descending section 54 of rim 50. So disposed prying means 40 of supporting and prying member 22 is used to upwardly pry bead 72 of lid 70 to lift male U-shaped section 68 of the lid out of the corresponding female U-shaped section 56 of rim 50. Prying means 40 pivots upon the top section 74 of rim 50 to lift bead 72 as downward forces are applied to handle 16 and ferrule 12. In this way, handle 16 and ferrule 12 provide leverage means, cooperating with prying portion 40, for easily prying the lid 70 off the can.

Alternatively, hook portion 42, prying portion 40, and the handle and ferrule can be made to cooperate in prying the lid. Accordingly, bent-over claw portion 46 is made to engage under or grasp bead 72 while prying portion 40 then abuts against lid 70 at a point radially inward of bead 72. Lifting force is delivered to lid 70 by upwardly pulling handle 16 whereby ferrule 12 and supporting and prying means 22 transmit the lifting force to the lid at claw portion 46. This manner of opening a plug-type can is sometimes preferable when dried paint is present on the rim from previous use of the can.

Brush 10, having supporting and prying means 22, thus provides a readily available implement for opening a paint can. Thus, it is unnecessary for the painter to carry other prying tools, such as a screw driver, in order to open the paint cans. The rounded prying edge of the prying means 40 protects against bending or twisting of the lid. Means 22 further permits the brush to be supported from the rim of the can with the bristles 18 directed downwardly to conduct dripping paint into the can and thereby prevents paint from acumulating upon the ferrule and the handle.

The supporting and prying means according to the present invention may be applied to any size brush. Thus the dimensions of said means can be varied so as to enable the brush to be supported from any conventional paint can and also to enable the brush to be used to open any can. Due to the unobtrusive size of the supporting and prying means in accordance with the present invention, the supporting and prying means does not interfere with either the normal use of the brush during painting or with packaging, transportation and display of the composite brush for retail sales purposes.

As will be apparent to those of ordinary skill in the art, supporting and prying means 22 can be provided with any conventional paint brush, mounted to the ferrule and the handle of the brush as in the case of brush 10 discussed hereinbefore with reference to FIGS. 1–4. Alternatively, and as is likewise evident to those of ordinary skill in the art, the supporting and prying means could be provided as a separate adapter member with a base portion as shown in FIGS. 1–4. The adapter member is thus mountable to any conventional paint brush by means of studs 24 or the like to adapt the brush to hang from the rim of the can as well as to provide an implement for prying the lid from the can.

A first alternative embodiment of an adapter member 100 according to the present invention is shown in FIGS. 5 and 6. Adapter member 100 likewise comprises a prying portion 102 and a hook portion 104 located between the prying portion and a longitudinal end 106. Prying portion 102 and hook portion 104 project from a base 108 comprising a tubular sleeve 110 adapted for fitting over the ferrule of a paint brush. Sleeve 110 telescopically receives the ferrule therein and may be secured to the ferrule by snug, frictional fit or by any conventional fastening means Sleeve 110 is thus dimensioned to accommodate any conventional paint brush.

Although the present invention has been substantially described with reference to one preferred embodiment, numerous modifications, rearrangements, and substitutions could be made, and the result would remain well within the scope of the invention.

What is claimed is:

1. A paint brush adapted to hang from the rim of a paint can in spaced relation from the walls of the can, said paint brush further being adapted to pry off the lid to open the can, said brush comprising:

an elongate handle;

bristles for applying paint;

a ferrule telescopically receiving the handle in one end thereof and anchoring the bristles in the other end; and supporting and prying means adapted to support said brush on the rim of the can, along the sidewalls of the can, and to pry open the can in cooperation with leverage means provided by said handle and said ferrule, said supporting and prying means including a prying portion projecting outwardly of said leverage means, and a hook portion, spaced-apart along said leverage means from said prying portion and projecting outwardly from said leverage means, said prying portion and said hook portion being adapted to contact the can and cooperate with the can to support said brush from the rim of the can with the bristles oriented downwardly into the can.

2. A paint brush, as claimed in claim 1, wherein said prying portion and said hook portion project outwardly from the same side of said leverage means, said hook portion being located between said prying portion and the end of the ferrule which receives the handle, both said prying and said hook portions being adapted to receive the rim of the can therebetween when the brush is supported from the rim of the can.

3. A paint brush, as claimed in claim 2, wherein said prying portion has a first upstanding portion projecting from said leverage means and a flat portion connected to the upstanding end of said first upstanding portion, and said hook portion has a second upstanding portion projecting from said leverage means and a bent-over claw portion connected to the upstanding end of said second upstanding portion.

4. A paint brush, as claimed in claim 3, wherein the rim has an inner wall section, having an inner side and an outer side, and a section connecting the inner wall section to the sidewalls of the can, said hook portion being engageable over the inner wall, whereby said claw portion contacts the outer side of the inner wall.

5. A paint brush, as claimed in claim 4, wherein said flat portion of said prying portion comprises a rounded prying edge.

6. A paint brush, as claimed in claim 5, wherein said hook portion projects outwardly from said leverage means further than said prying portion, the spacing between said flat portion and said second upstanding portion being less than the height of the inner wall of the rim, said flat portion being adapted to abut the inner side of the inner wall when said brush is supported from the rim of the can whereby the bristles are oriented in a substantially parallel, spaced relationship away from the sidewalls of the can.

7. A paint brush, as claimed in claim 6, wherein said supporting and prying means further comprises a base portion connecting said hook and said prying portions, said base portion being mounted to said side of said leverage means.

8. A paint brush, as claimed in claim 5, wherein said hook portion projects outwardly from said leverage means for a lesser distance than said flat portion, the spacing between said flat portion and said second upstanding portion being greater than the height of the inner wall of the rim, said flat portion being adapted to abut the sidewalls of the can when said brush is supported from the rim of the can, whereby the bristles are oriented in a substantially parallel, spaced relationship away from the sidewalls of the can.

9. An adapter member for a paint brush having a handle, bristles and a ferrule with one end for telescopically receiving the handle and another end for anchoring the bristles therein, said adapter member adapting the paint brush to hang from the rim of a paint can in spaced relation from the walls of the can, said adapter member further adapting the brush to provide a tool for prying the lid of the can to open the can, said adapter member comprising:

a base portion having two longitudinal ends, a front face, and a rear face, said base portion being mountable to the ferrule and the handle of the brush with said two longitudinal ends aligned along the longitudinal axis through the brush, said rear face contacting a side of the ferrule;

a prying portion projecting outwardly from said front face, one of said longitudinal ends comprising said prying portion; and a hook portion being located between said prying portion and the other of said longitudinal ends, in spaced relation to said prying portion, and projecting outwardly from said front face, said prying portion and said hook portion being adapted to contact the can and cooperate with the can to support said brush from the rim of the can with the bristles oriented downwardly into the can, said prying portion further being adapted to cooperate with leverage means provided by the handle and the ferrule of the brush to pry off the lid of the can.

10. An adapter member, as claimed in claim 9, wherein said prying and said hook portions are adapted to receive the rim of the can therebetween to support the brush from the rim of the can.

11. An adapter member, as claimed claim 9, wherein said prying portion has a first upstanding portion projecting from said front face of said base portion and a flat portion connected to the upstanding end of said first upstanding portion and said hook portion has a second upstanding portion projecting from said front face of said base portion and a bent-over claw portion connected to the upstanding end of said second upstanding portion.

12. An adapter member, as claimed in claim 11, wherein said base portion comprises a sleeve adapted to slidably mount over the ferrule of the brush.

13. An adapter member, as claimed in claim 12, wherein said flat portion of said prying portion comprises a rounded prying edge.

14. An adapter member, as claimed in claim 11, wherein the rim has an inner wall section having an inner side and an outer side, and a section connecting the inner wall section to the sidewalls of the can, said hook portion being engageable over the inner wall, wherein said claw portion contacts the outer side of the inner wall.

15. An adapter member, as claimed in claim 14, wherein said flat portion of said prying portion comprises a rounded prying edge.

16. An adapter member, as claimed in claim 15, wherein said hook portion projects outwardly from said front face further than said prying portion, the spacing between said flat portion and said second upstanding portion being less than the height of the inner wall of the rim whereby said flat portion abuts the inner side of the inner wall when the brush is supported from the rim of the can.

17. An adapter member, as claimed in claim 16, further comprising fastening means for securing said base portion to said leverage means.

18. An adapter member, as claimed in claim 17, wherein said first and second upstanding portions are inclined.

19. An adapter member, as claimed in claim 15, wherein said hook portion projects outwardly from said front face for a lesser distance than said flat portion, the spacing between said flat portion and said second upstanding portion being greater than the height of the inner wall of the rim, said flat portion being adapted to abut the sidewalls of the can when said brush is supported from the rim of the can, whereby the bristles are oriented in a substantially parallel, spaced relationship away from the sidewalls of the can.

20. A paint brush adapted to hang from the rim of a paint can in spaced relation from the walls of the can, said paint brush further being adapted to pry off the lid to open the can, said brush comprising:

an elongate handle;

bristles for applying paint;

a ferrule telescopically receiving the handle in one end thereof and anchoring the bristles in the other end; and supporting and prying means for suspending the brush from the rim of the can in spaced relation from the walls of the can and for prying off the lid of the can, said supporting and prying means including means having a first portion for prying open the can in cooperation with leverage means provided by said handle, and a second portion for connecting said first portion in spaced-apart relation to said leverage means.

21. An adaptor member for a paint brush having a handle, bristles and a ferrule with one end for telescopically receiving the handle and another for anchoring the bristles therein, said adaptor member comprising:

a base member being mountable to the ferrule and the handle of the brush; and supporting and prying means connected to said base member for suspending the brush from a rim of a point can in spaced relation from a wall of the can and for prying off a lid of the can, said supporting and prying means including a first portion for prying open the can in cooperation with leverage means provided by the handle of the paint brush; and a second portion for connecting said first portion in spaced-apart relation to said leverage means.

* * * * *